United States Patent [19]

Boniface

[11] 4,054,183

[45] Oct. 18, 1977

[54] CONTROLLED-SPEED DESCENT DEVICE

[76] Inventor: George I. Boniface, 6935 Espey Lane, McLean, Va. 22101

[21] Appl. No.: 636,086

[22] Filed: Nov. 28, 1975

[51] Int. Cl.[2] ..... A62B 1/14

[52] U.S. Cl. ..... 182/142; 182/7; 187/73; 188/65.4; 254/156

[58] Field of Search ..... 187/73, 6; 182/5–7, 182/191, 192, 142; 188/65.4, 65.5; 254/151, 154–156

[56] References Cited

U.S. PATENT DOCUMENTS

| | | | |
|---|---|---|---|
| 387,772 | 8/1888 | Debus | 254/151 |
| 481,923 | 9/1892 | Badger | 182/6 |
| 496,923 | 5/1893 | Walgren et al. | 254/156 |
| 643,286 | 2/1900 | Feiker | 254/151 |
| 643,575 | 2/1900 | Walker et al. | 254/155 |
| 688,592 | 12/1901 | Chadwick | 254/155 |
| 715,876 | 12/1902 | Rupp | 188/65.5 |
| 770,012 | 9/1904 | Kramer | 182/6 |
| 835,180 | 11/1906 | Cruickshank | 187/8 |
| 876,840 | 1/1908 | Reuter | 188/65.4 |
| 3,739,875 | 6/1973 | Clark-Padwicki | 182/6 |

*Primary Examiner*—Evon C. Blunk
*Assistant Examiner*—Jeffrey V. Nase
*Attorney, Agent, or Firm*—Depaoli & O'Brien

[57] ABSTRACT

A controlled-speed device for lowering passengers and materials on a cable or rope from an elevated structure, using paired banks of alternatively opposed arms, pivotably anchored to a rigid frame, for controllably inducing friction in a cable zigzagging between the tips of the arms by varying both pressure upon and length of arcuate contact with the cable or rope. The device is selectively attached to an elevated structure or descends with the load. The arms are inclined upwardly or downwardly but generally are always inclined toward the incoming portion of the cable. The cable is selectively a single length, a double length, or endless. The tips of the arms have a groove, through which the cable passes, which is covered with a frictional composition or alternatively the cable passes over a roller attached to a brake assembly on each arm. The arms are selectively solid or have a resiliency device for absorbing shocks and minimizing binding forces upon the cable that could cause jerkiness in movement.

20 Claims, 20 Drawing Figures

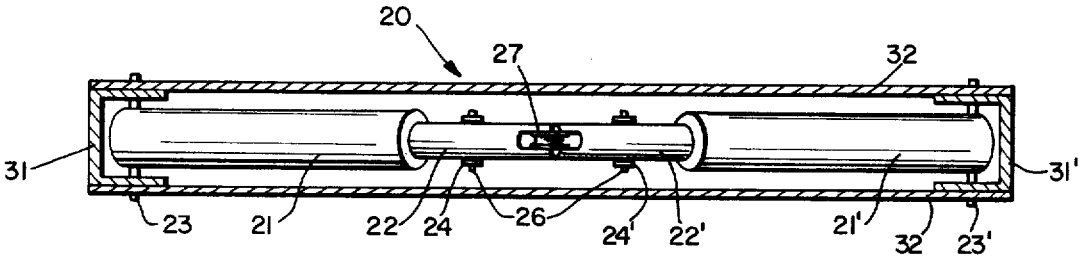
FIG. 2
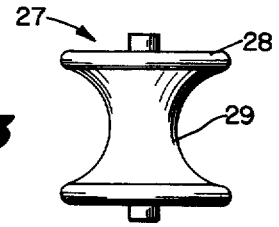
FIG. 3
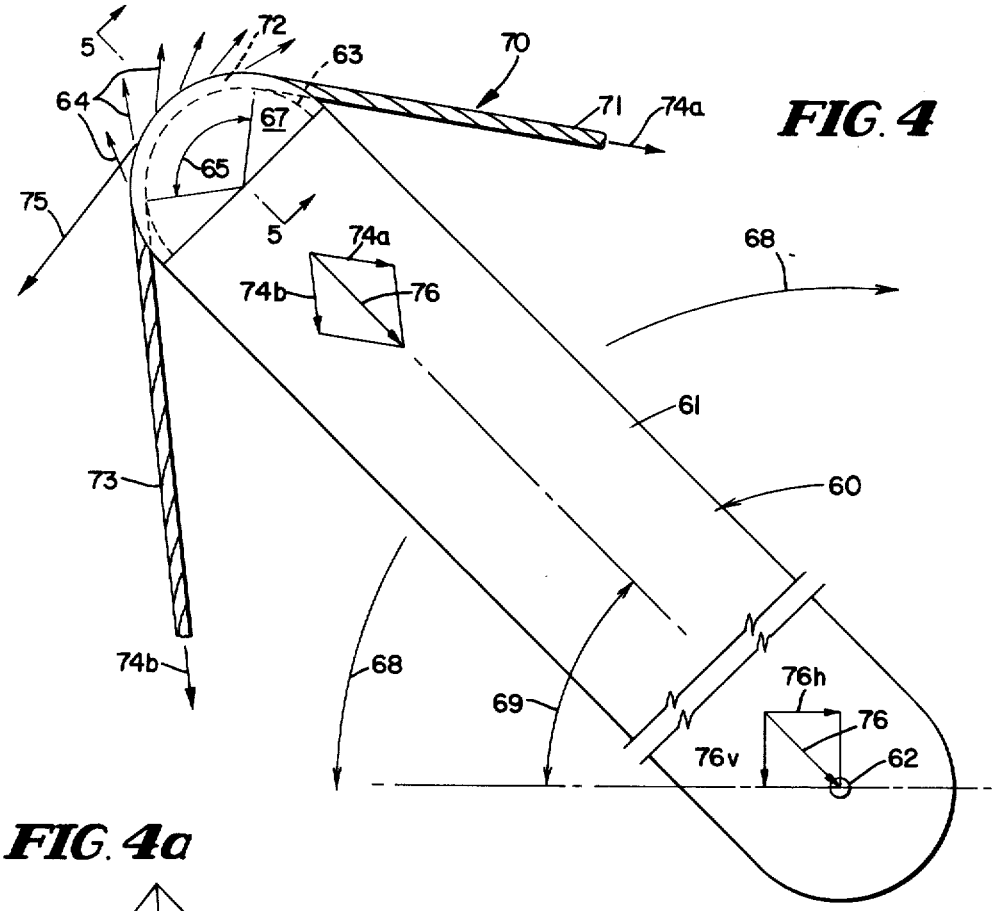
FIG. 4
FIG. 4a
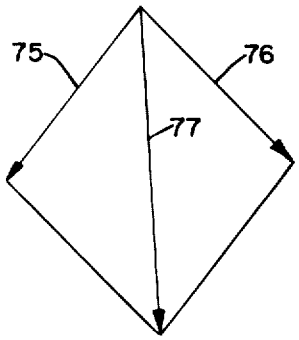
FIG. 5
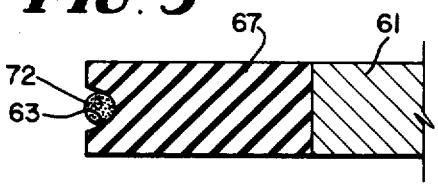

FIG. 12
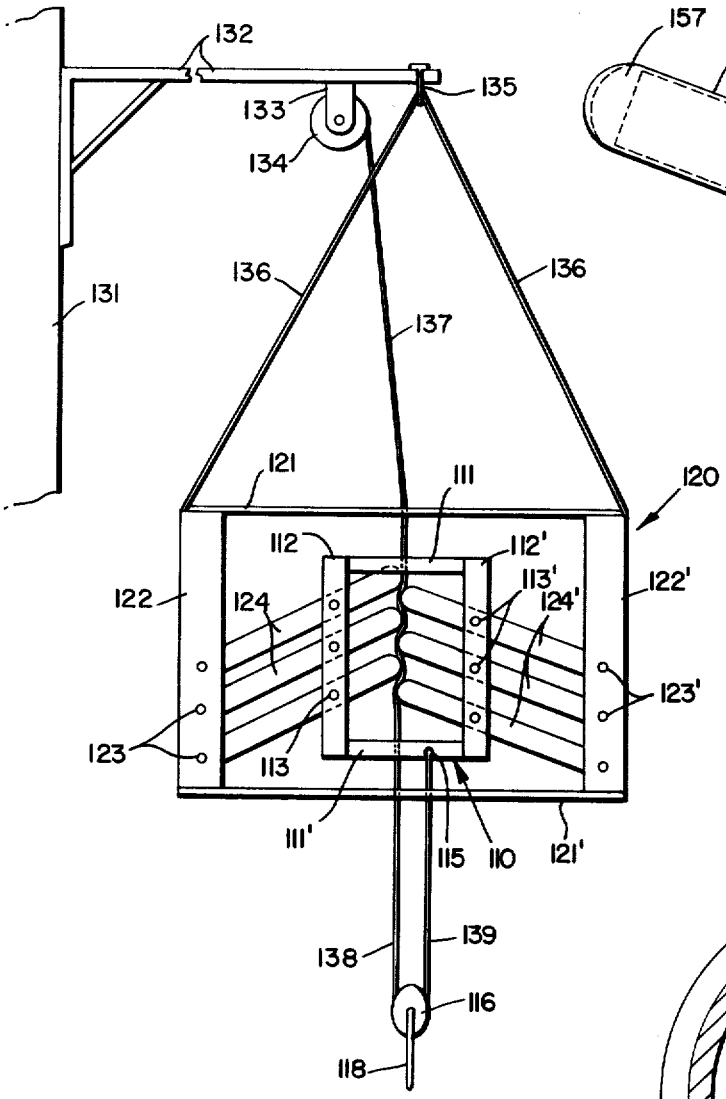
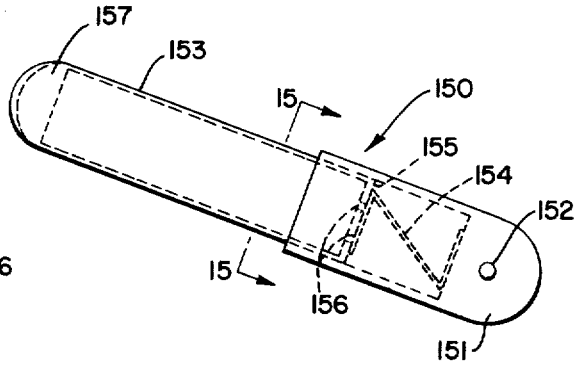
FIG. 14
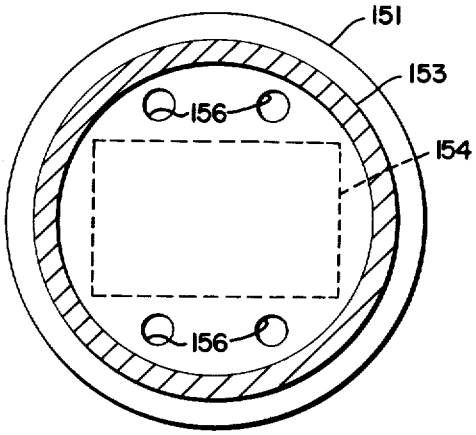
FIG. 15
FIG. 13
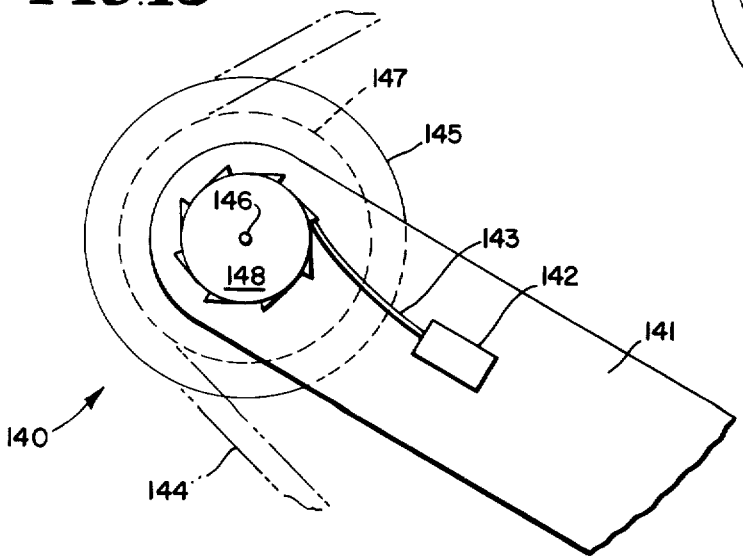

CONTROLLED-SPEED DESCENT DEVICE

BACKGROUND OF THE INVENTION

1. Field of the Invention

This invention relates to devices for lowering heavy loads along a suspended cable from an elevated location and particularly relates to fire escape devices. The invention especially relates to controlled-velocity escape devices which are selectively attached to a building or descend with a passenger.

2. Review of the Prior Art

Devices for safe passage down a flexible tensional support means, such as a rope or cable, that is attached to an elevated object, such as the top of a building, a cliff, or a mine shaft, have been known for many centuries. Safe descent in such devices has required control of the speed of descent and has been provided by subjecting the cable to great pressure over a limited area of contact, by frictionally engaging the cable over an extended area of contact with relatively light pressure, or by utilizing a braking means, such as a winch having a spring-controlled ratchet wheel. Examples among early United States patents of these three types are, respectively, U.S. Pat. Nos. 387,772, 496,923, and 643,286. Speed control has been imparted by pre-setting a braking means according to the weight of the passenger at the beginning of the descent, by manipulating a passenger-operated braking means that is under control of the passenger during the descent, or by using an automatically operating braking means that is responsive to the weight of the passenger or other load. Examples among United States patents of these three types are, respectively, U.S. Pat. Nos. 643,286, 481,923, and 854,922. Devices utilizing relatively light pressure over an extended area of contact generally provide a tortuous, serpentine, or sinusoidal path of travel for the cable and achieve speed control, whether with a passenger-operated means or with a weight-responsive means, by varying the area of contact or the pressure exerted upon the cable in accordance with the weight of the load, examples being respectively, U.S. Pat. Nos. 876,840 and 835,180.

Varying the area of contact has usually involved changing the total arc of contact of the cable with a frictional surface such as a pulley or roller, such as by moving the center-to-center distance apart between the rollers in a single series of rollers around which the cable is sinusoidally wound or by moving the rollers in a pair of parallel series into greater or lesser proximity, examples being, respectively, U.S. Pat. Nos. 3,739,875 and 876,840.

These devices, notwithstanding their variety, are apparently adapted for merely a single type of installation and usage, such as being fastened to a building (an example being U.S. Pat. No. 854,922) or moving with the escaping passenger (an example being U.S. Pat. No. 3,739,875). Both physical strength and presence of mind are needed for controlling speed of descent in the devices having levers and the like to be operated by a passenger. Clearly, frightened elderly persons are incapable of using such devices, as when escaping from a burning building, so that they are unsafe for these people.

Fire-escape devices as discussed hereinbefore have not been generally adopted because of high cost, large size, awkwardness in handling, and necessity for passenger operation to control speed of descent. An automatically weight-responsive device that is light, simple to construct, reliable, and versatile as to installation and usage is clearly needed for enabling one or many people to escape from upper floors of burning buildings and for lowering people and equipment during mining operations, mountain climbing, cave exploring, and construction activities, for example.

SUMMARY OF THE INVENTION

It is accordingly an object of this invention to provide a descent device which is capable of lowering a load, such as a person or materials, along a vertically disposed tensional support means at a selected regulated rate of descent.

It is another object to provide a descent device that is selectively attachable to a building or usable to accompany a load from an elevated position to a lower position.

It is a further object to provide a descent device having a resiliency means for imparting a uniform rate of descent thereto, for absorbing shocks, and for minimizing binding forces that could cause jerkiness and sudden stoppages.

It is an additional object to provide a descent device which is light, small in size, and simple to construct.

It is additionally an object to provide a descent device which is automatically responsive to the weight of its load so that it controls the speed of descent to a selected safe speed.

It is still further an object to provide a descent device having a speed-control means for varying speed of descent from a fast initial speed to a much slower terminal speed.

It is also an object to provide a descent device constructed as a passenger chair for use during escape from a burning building and incorporating at least one friction-inducing means for controlling the speed of descent to a selected safe speed.

In accordance with these objects and the spirit of this invention, a descent device is described herein which comprises a rigid anchor frame and a weight-responsive friction-inducing means for restricting a load-supporting cable passing therebetween to a selected zigzag path and for selectively tensioning the cable and thereby increasing cable-retarding friction in proportion to the weight of the load. This friction-inducing means comprises a pair of banks of parallel and alternatively opposed friction-inducing arms which are pivotably attached to the frame and have cable-retarding tips over which the cable passes in arcuate contact along the zigzag path. In general, the greater the weight of the load, the greater the induced friction upon the cable along the zigzag path.

Friction which is created by the cable passing over each tip generates a turning moment that tends to pivot each arm more nearly transversely to the zigzag path and a force vector that is longitudinally exerted along each arm and upon each anchor pin in the frame and which presses the cable into tighter contact with each tip. When the turning moment pivots the arms toward the direction of cable movement, it also lengthens the length of arcuate contact between the cable and each of the tips. Consequently, friction is increased by both increased pressure and greater length of arcuate contact. The pivoting capability of the arms in alternatively opposed contact with the cable along the zigzag path consequently imparts a high degree of responsiveness and speed-control flexibility to the descent drive of this invention.

In general, the arms are always inclined toward the incoming cable and are accordingly inclined upwardly when the device itself is attached to a fixed elevated structure, such as a top of a building or cliff, while the cable feeds downwardly and are inclined downwardly when the cable is so attached and the device accompanies the load in its downward path. The arms can be interlaced to form a highly looped zigzag path having maximum arcuate contact and can alternatively rest upon a bottom member of the frame and upon each other in transverse relationship to the taut cable in a rest position which also creates maximum arcuate contact between the arms and the cable. Because the arms are immobilized by the weight of the load while in this rest position, however, the descent device is relatively nonresponsive to shocks and has speed-control capability only over a relatively narrow range.

Each bank of arms is preferably attached pivotably to a tie rod that is disposed in parallel to the taut cable, one tie rod being attached to a return run thereof so that the weight of the load is exerted upon the attached bank of the arms to pivot them toward transverse relationship to the taut cable, the other bank being free floating but the arms thereof being operable in unison. Both tie rods can also be rigidly interconnected to form a tie-rod frame, whereby both rows of arms can be simultaneously pulled toward a position of maximum opposition and maximum arcuate contact of cable and tips.

Each tip is grooved and preferably constructed of a frictional material, such as leather or an elastomeric composition of the type used for heels of shoes. Alternatively, each tip is a rotatable roller which is attached to a braking mechanism.

A resiliency means, using springs, a hydraulic dampening system, or both, is selectively provided in order to obviate shocks from inadvertently occuring clamping of the cable, swaying of the load, occurrence of kinks in the cable, and the like. The friction-inducing device of the invention is also selectively combined into a passenger-carrying chair that supports a passenger in a regulated-velocity ride down a cable which is attached to a supporting structure, such as the top of a tall building, as a combination fire-escape device or for descent from a cliff or into a mining shaft, for example.

The cable is preferably a steel cable or wire rope, such as cable of ⅛-inch diameter, for fire-escape usage. However, for use in construction work, mining, mountain climbing, and the like, manila or polypropylene rope is satisfactory.

BRIEF DESCRIPTION OF THE DRAWINGS

FIG. 2 is a cross section of the descent device of FIG. 1, taken along the line 2—2 of FIG. 1.

FIG. 3 is an enlarged side elevation of a spool which is attached to the tip of each arm in the device of FIG. 1.

FIG. 4 is a sketch of a friction-inducing rigid arm having a friction tip over which a steel cable passes zigzaggingly. The arm is inclined at a selected angle, with the tensional forces in the cable, the turning moment, and the force vectors along the arm illustratively represented.

FIG. 4*a* is a vector diagram of forces created by the arm of FIG. 4.

FIG. 5 is a view in section of the tip and cable of FIG. 4, taken along the line 5—5 of FIG. 4.

FIG. 12 is a front elevation of a descent device which is attached to a bracket from a building and comprises a tie-rod frame which is pivotably attached to both banks of arms, each arm being pivotably attached to the anchor frame.

FIG. 13 is a side elevation of a friction-inducing arm having a roller equipped with a ratchet wheel which is acted upon by a spring pawl as a movement-retarding means.

FIG. 14 is a side elevation of a piston-and sleeve friction-inducing arm having a hydraulic damping means and a leaf-spring positioning means.

FIG. 15 is a cross-section of the piston and sleeve of FIG. 14 taken along the line 15—15 of FIG. 14.

DESCRIPTION OF THE PREFERRED EMBODIMENTS

Figure 1:
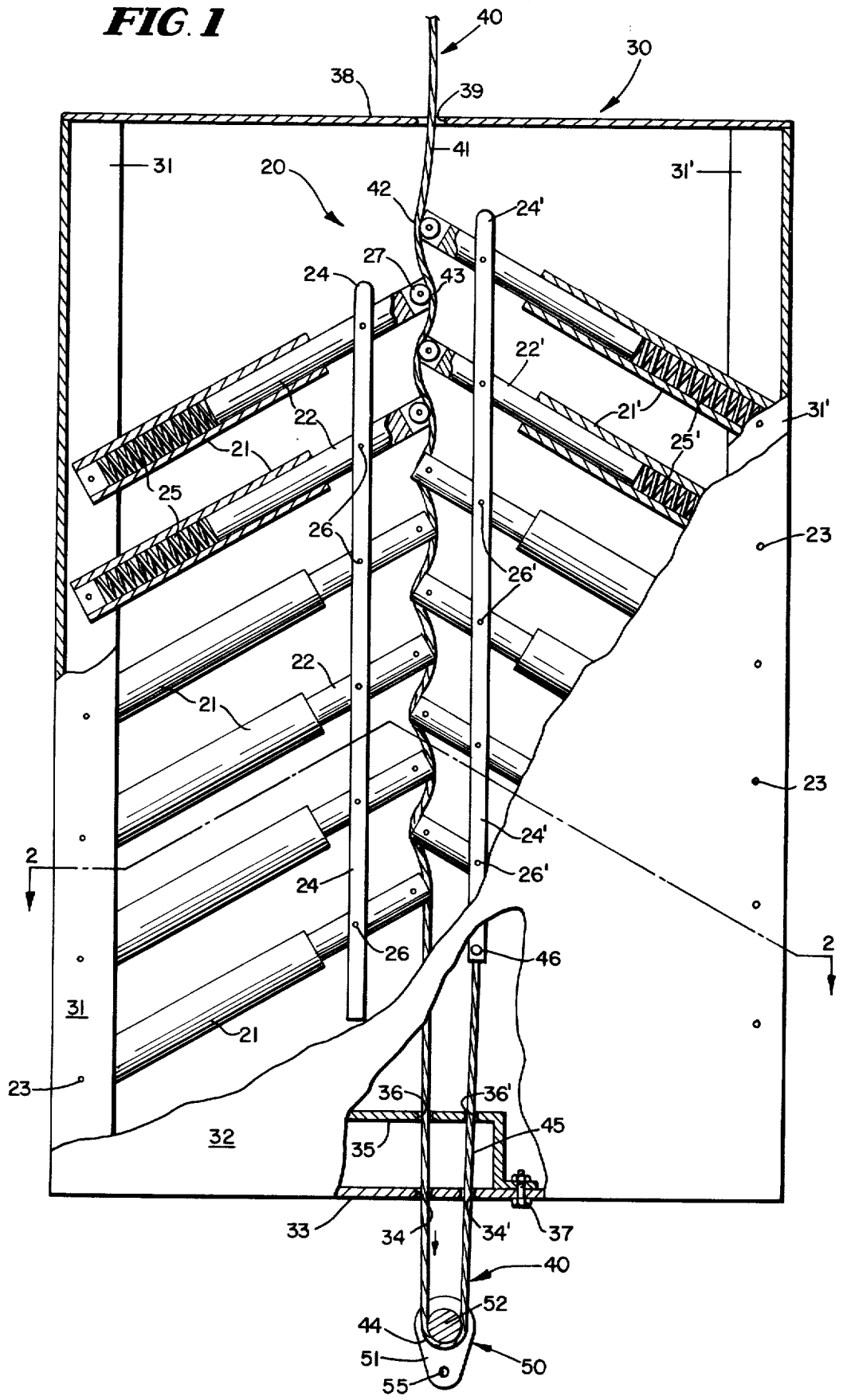
FIG. 1 shows a sandwich-panel embodiment of the invention having a portion of the panel broken away to reveal a pair of tie rods, each tie rod being pivotably attached to one bank of arms, and to show the attachment of the return run of the cable to one of the tie rods. The embodiment is attachable to a supporting structure.

The friction-inducing descent device that is shown in FIGS. 1, 2, and 3 comprises a resilient friction inducer 20 and an anchor frame 30. The anchor frame 30 is rigidly constructed and comprises side channel members 31, 31', sandwich panels 32 which are attached to the side members 31, 31', a bottom frame member 33 having cable openings 34, 34' therein, an exit stop box 35 having cable openings 36, 36' therein, bolts 37 for fastening the box 35 to the bottom frame member 33, and a top frame member 38 having a cable opening 39 therein.

The resilient friction inducer 20 comprises a pair of banks of inclined arms. The banks being alike, each arm of the left-hand bank is herein described as being formed from a sleeve 21, a spring 25, and a piston 22 which slides within the piston 21 and is engaged by the spring 25. The sleeve 21 is pivotably attached to a side channel member 31 with an anchor pin 23. A roller 27 is rigidly attached to the outer end of each piston 22, having a friction surface 29 and a pair of flanges 28 on each end thereof. A tie rod 24, which is disposed in parallel to the side channel members 31, 31', is pivotably attached to the bank of pistons 22 with tie rods pins 26.

A cable 40 is supplied from a source, which is not shown in the drawings, such as a reel or cannister, and comprises an incoming cable 41 which enters cable opening 39 and passes over each roller 27, 27' in a zigzag path 42, 43. The cable 40 finally emerges from the device through cable openings 36, 34 to pass around load block 50 and upwardly as return run 45 through cable openings 34', 36' to tie pin 46 where it is attached to the tie rod 24', either tie rod 24 or 24' being satisfactory for attaching the tie pin 46. The load block 50 comprises a casing 51, a pulley 52 around which the cable 40 passes, and a load pin 55 which supports the load, such as a passenger escaping from a burning building or bundle of pipes being lowered into a subway station under construction.

The roller 27 is selectively attached to the piston 22 so that it is fixed, difficulty rotatable, or rotatable against the pressure of a braking mechanism. A suitable braking assembly, for example, is shown in FIG. 13 as comprising a roller 145 which is rotatably attached on a pin 146 to an arm 141 as the tip thereof, a ratchet wheel 148 which is rigidly attached to the roller 145, a spring pawl 143 which bears against the ratchet wheel 146, and a lug 142 which is attached to the arm 141 and rigidly holds one end of the spring pawl 143. The rollers 145 has a groove 147 therein through which a cable 144 passes without excessive slippage.

In FIG. 4, a graphical analysis is shown of some of the forces involved in a typical friction-inducing arm 60 of this invention without a resiliency means. The arm 60 has a rigid portion 61 which pivots on an anchor pin 62 and has a tip 67 formed of a friction-enhancing composition, with a hemi-circumferential groove 63 therein through which a cable 70 passes, as seen in FIG. 5. The cable has an incoming run 71, a tip-contacting run 72, and an outgoing run 73. The run 72 creates frictional resistances 64 throughout the arc of contact 65 along the bottom of the groove 63. These forces 64 are resolvable into a resultant which represents the frictional opposition to movement of the cable 70 through the groove 63. Such a frictional resultant, which is not shown in FIG. 4, has an opposite force 75 which is the frictional force exerted by the cable 70 upon the arm 60. The force 75 can be resolved to isolate a moment that is perpendicularly disposed to the arm 60. This moment is not shown in the drawings.

The run 71 and the run 73, which are shown as being equally inclined to the arm 60, are under tension **74*a* and 74*b*, respectively. These tensional forces 74*a* and 74*b* are also drawn along the center line of the rigid portion 61 and resolved into an axially directed compression force 76 which acts upon the pin 62 and is resolved, in the vicinity of the pin 62, into a horizontal force 76*h* and a vertical force 76*v*. An equal force, acting oppositely to force 76, is exerted by pin 62 and along arm 60 against the cable 70. In FIG. 4*a*, the frictional force 75 and the tensional force 76 are resolved into what is herein termed a cable force 77 which expresses the net force upon the arm 60 created by the cable 70 passing over the tip 67. Such a force 77 has an opposing force, herein termed an arm force, which expresses the opposing force exerted by the arm 60 in resisting the cable 70. As the angle of inclination 69 of the arm 60 to the horizontally disposed bottom frame member varies, the angles of inclination of the runs 71 and 73 vary correspondingly so that the resultant force 77 of the arm 60** of a typical friction-inducing device of this invention also changes.

Clearly the force analysis in FIGS. 4 and **4*a* shows that the cable force creates an automatically responsive pressure of varying magnitude that brings the run 72 and the groove 63 into very effective braking contact. As the arm 60 pivots through the arc 68 toward a horizontal position, thereby decreasing the angle of inclination 69, as shown in FIG. 4, the runs 71, 73 tend to become more sharply inclined to the arm 60 so that the compression force 76 becomes markedly greater and its opposite force, expressing the resistance of the arm 60 to the tension of the cable 70, likewise becomes greater, thereby increasing the pressure between the cable run 72 and the groove 63, thus increasing the frictional resistance 64 and the frictional resultant force 75 which seeks to turn the arm 60. As the angle of inclination 69 decreases to zero, the turning moments become so great that tie rods are not needed or at least need not be attached to the cable, as at 46 in FIG. 1. Generally, the sum of the vertical forces 76*v* of all the arms 60 in a descent device of this invention should equal the load on the cable 70**.

Consequently, the alternatively opposed disposition of the paired banks of generally parallel arms and their pivotable attachment to a rigid anchor frame, which is capable of withstanding the sum of the pressures **76*h*** generated along the zigzag path by the cable resultants of all arms, imparts a high degree of responsiveness and speed-control flexibility to the descent device of this invention.

Figure 6:
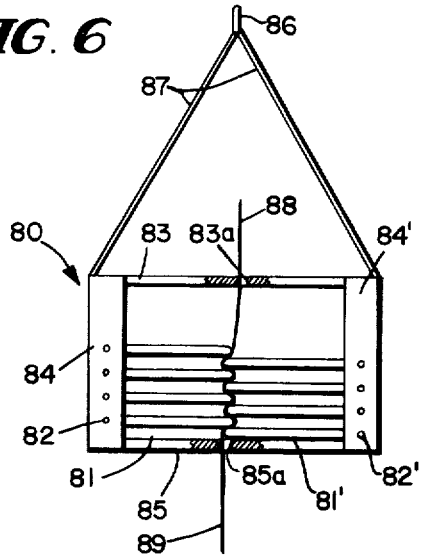
FIG. 6 is a side elevation of a descent device in which the pivotably-attached banks of arms rests upon the bottom of the frame in substantially perpendicular relationship to the taut cable.

Conditions of high pressure between a cable and the grooves along its zigzag path are believed to occur in the descent device 80 of FIG. 6 in which arms 81, 81' are pivoted upon anchor pins 82, 82' in side frame members 84, 84' which are rigidly interconnected by top frame member 83 and bottom frame member 85 having cable openings **83*a* and 85*a*, respectively, therein. Struts 87 attach the side frame members 84, 84' to a bracket 86 which is attached to an elevated structure, such as the top of a building. The incoming run 88 of the cable passes through the opening 83*a* and zigzaggingly over the tips of the arms 81, 81' and through the opening 85*a* to emerge as outgoing run 89. The bottom arm 81' clearly rests upon the bottom frame member 85, and the next highest arm 81 rests this arm 81' so that the device 80, having minimum angle of inclination for its arms 81, 81', is believed to have substantially maximum frictional characteristics from tensional forces but with no capacity to vary the frictional forces by changing inclination of its arms 81, 81'. A heavier load should increase the frictional force in direct proportion thereto. However, the change in frictional resistance that can be created by change of the angle of inclination 69, as shown in FIG. 4, and the increase in the resultant 76, caused by the runs 71, 73 approaching closer to the arm 60 in FIG. 4, are not available in the device shown in FIG. 6**.

Figure 8:
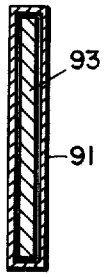
FIG. 8 is a cross-section of the sleeve and piston of FIG. 7, taken along the line 8—8 of FIG. 7.
Figure 7:
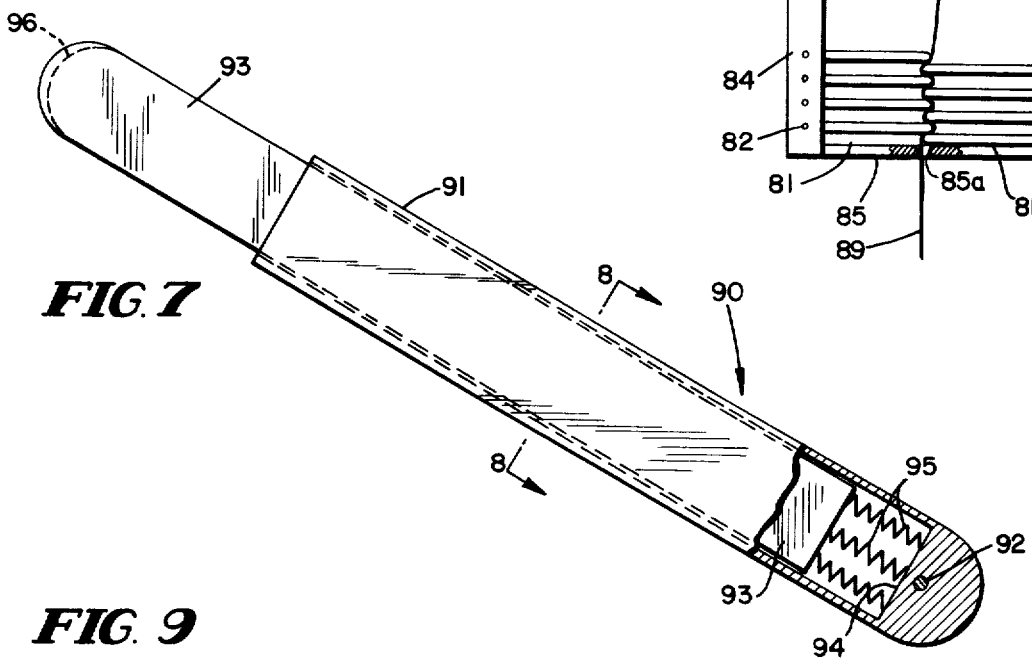
FIG. 7 is a side elevation, partly in section, showing a piston-and sleeve arm of rectangular cross section which has a resiliency means formed by a plurality of coiled springs.

In FIGS. 7 and 8, a thin, narrow arm 90 is illustrated. The arm 90 comprises a thin and narrow sleeve 91 which pivots upon an anchor pin 92 and has a bottom 94 fitted with a spring means, such as a leaf spring or a plurality of coiled springs 95. A similar thin and narrow piston 93, having a frictional groove 96 in its tip, fits within the piston 91 and presses upon the springs 95 which form a resiliency means.

Figure 9:
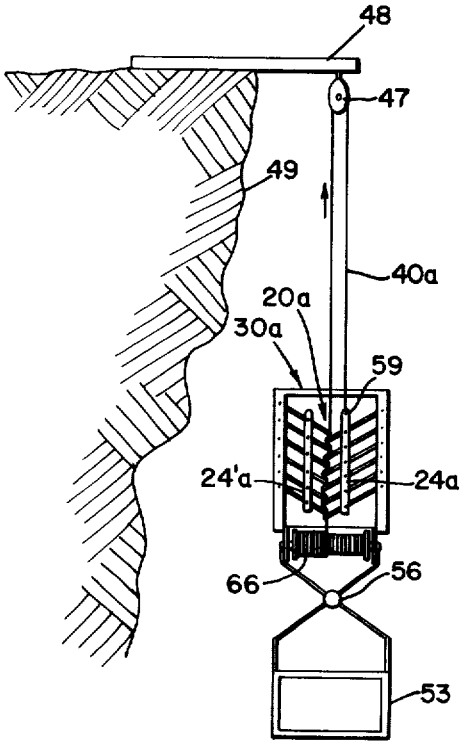
FIG. 9 illustrates the embodiment of FIGS. 1 and 2 in inverted position while being used to lower a load of materials along a cable which is attached to the top of a cliff, a pulley being added to enable the cable to pull upon a tie rod in the direction of relative cable movement.

FIG. 9 illustrates usage of the descent device of FIG. 1 in inverted position to lower a pallet of materials 53 from an elevated position at the top of a cliff 49 where a beam 48 is rigidly braced. The descent device comprises a reel 66 which is attached to the frame **30*a* along its lower side and on which a cable 40*a* is stored. This cable 40*a* passes upwardly along a zigzagging path between the alternatively opposed tips of the paired and downwardly inclined arms 20*a*, passes over the pulley 47, and returns to fastening position 59 on a tie rod 24*a* of the inverted device. The load 53 is attached to a load ring 56 which is attached to the device or to the reel 66 as shown in FIG. 9. The upward force exerted by the cable 40*a* on the tie rod 24*a* thus tends to lessen the angle of inclination for the arms 20*a*** and increase the cable force for this system.

Figure 10:
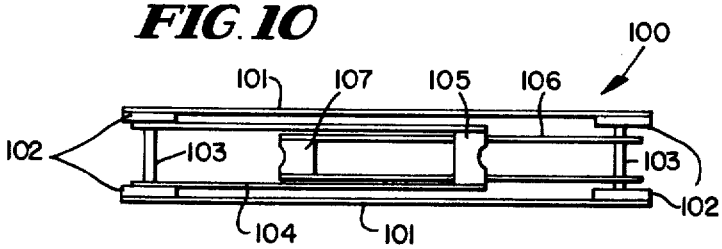
FIG. 10 is a top view of a friction-inducing descent device in which the rows of arms are deeply interlaced to form a highly looped zigzag path for the cable therebetween.
Figure 11:
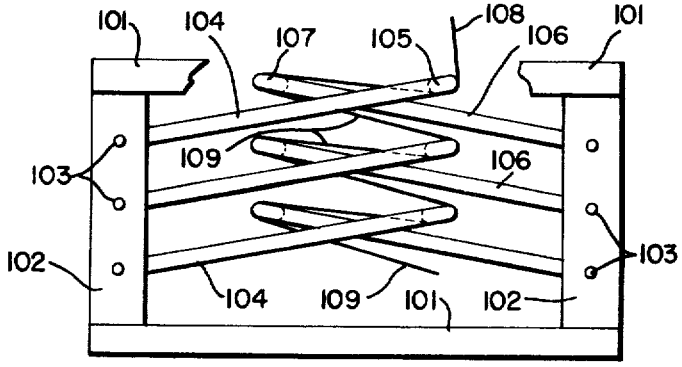
FIG. 11 is a front elevation of the descent device of FIG. 10.

In the descent device 100 of FIGS. 10 and 11, a rigid frame, comprising horizontal members 101 and vertical members 102, is attached to a bank of arms 104 and an alternatively opposed bank of arms 106 with anchor pins 103. The arms 104, 106 have respective tips 105, 107. An incoming run 108 of the cable passes over the first tip 105 and nearly horizontally to and over the next tip 107 and zigzaggingly downwardly therefrom as runs 109. The arm 101 has two widely spaced portions, and the arm 106 has two portions which are more closely spaced so that the two arms interlace and fit between each other.

FIG. 12 shows a descent device 120 which is attached to a building 131 with a bracket 132 and a hook 135 by means of tension members 136. The descent device 120 comprises an anchor frame made of horizontal frame members 121, 121' and vertical frame members 122, 122'. Its arms 124 124' are attached to the side members 122, 122' with anchor pins 123, 123'. The tension members 136 are attached to the side members 122, 122'. The two banks of alternatively opposed arms 124, 124' are attached with tie-rod pins 113, 113' to a rigid tie-rod frame 110 comprising rigidly interconnected horizontal frame members 111, 111' and vertical frame members 112, 112'. A cable, stored on a reel 134, which is attached with a lug 133 to the bracket 132, passes as incoming run 137 to the tie-rod frame 110 and zigzaggingly between the tips of the arms 124, 124', emerging from the descent device 120 as outgoing run 138 to a load block 116 and upwardly again as run 139 to the cable tie pin 115 on the tie-rod frame 110. A load, such as a passenger, is supported from the load block 116 with a load line 118.

As an alternative embodiment, the device 120 can be a load-accompanying device by inverting the device 120, attaching the load to it by any convenient means, and passing the incoming cable 137 downwardly between the downwardly inclined and alternatively opposed arms 124, 124' to a pulley attached to member 121, upwardly to a pulley attached to member 121', and then downwardly to fastening position 115. The inverted device 120 is attached to the load, and the cable is fastened to the hook 135; thus the incoming run of the cable is below the inverted device 120.

FIGS. 14 and 15 show an arm 150 having a hydraulic resiliency means. The arm 150 comprises a round sleeve 151 which pivots on an anchor pin 152 and a closely fitting piston 153 which is hollow and has an end 155 perforated by a selected number of holes 156 which are designed to provide a desired rate of shortening of the arm 150. The cavities in the sleeve 151 and the piston 153 are filled with a hydraulic fluid, and the piston 153 is kept in its extended position by a relatively weak leaf spring 154. A descent device using arms 150 accordingly is capable of varying the pressure exerted between its tips 157 and a cable passing thereover because the arms 150 become shorter while pivoting downwardly because of the load. Therefore, instead of a load causing a frictional resistance that is solely a function of its weight, a descent device using arms 150 can possess a frictional force that varies with time so that over descending time of perhaps two minutes the arms 150 can be a designed to have an initial frictional pressure and a different terminal pressure whereby the initial descent can be designed to be quite rapid and the terminal descent can be designed to be relatively slow.

Figure 16:
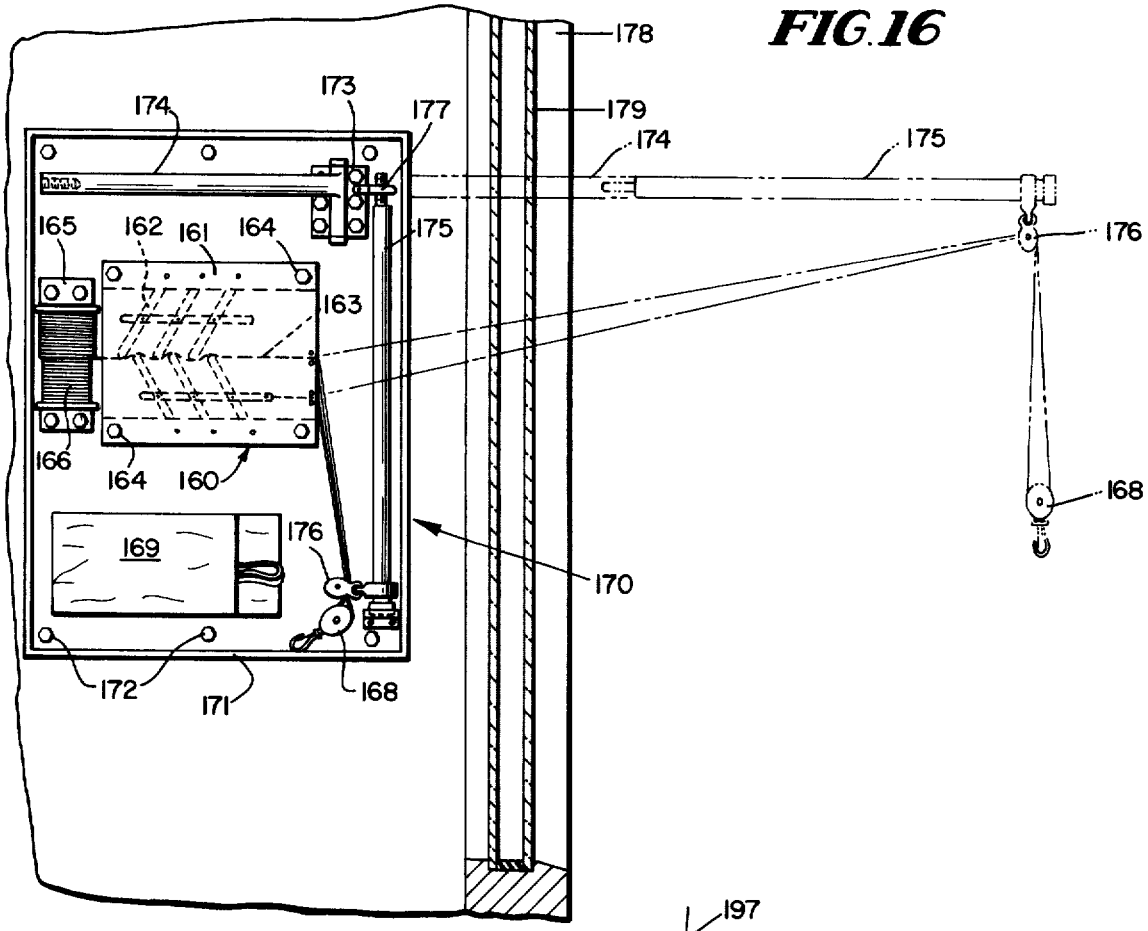
FIG. 16 is a plan view of a descent device within a mounting and suspension assembly, with cover removed, which is shown mounted on, or embedded within, the wall of a building.

FIG. 16 shows a sandwich-panel descent device 160 which is stored within a mounting and suspension assembly 170 that is attached to the wall of a building or aesthetically embedded therewithin for standby use in event of fire or other disaster. The mounting and suspension assembly comprises a box 171 which is attached to the building with bolts 172, a hinge 173 that is also bolted to the building and pivotably supports an arm 174 having an internally threaded end, and an extension arm 175, having an externally threaded end, which is attached to the box 171 with straps 177. The box 171 must be located adjacent to a window 178, having a pane 179, in the wall of the building. When needed, the arm 175 is removed and threadably conjoined to the arm 174.

The device 160 is strongly attached to the building with bolts 164 and comprises a reel 165, also attached to the building, on which is wound a steel cable 166 which passes between the panels 161 and along a zigzag path 163 between the alternatively opposed tips of the arms 162 which are pivotably inclined against the directions of cable movement. The cable 166 emerges to form a dangling block 168. A zippered and fire-retardant jump suit 169 is also folded and stored within the box 171. It has a snap hook for attachment to the block 168.

When needed, the conjoined Arms 174, 175 are swung through the window 178 (after breaking the pane 179, if necessary), and a person, who has clothed himself in the jump suit 169, attaches its snap hook to the block 168, sits on the sill of the window 178 while adjusting the cable 166 to a substantially slackless condition, and swings himself out from the building to begin a rapid but safe descent to the ground.

Figure 17:
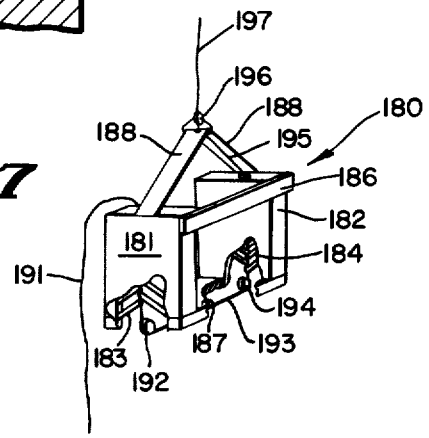
FIG. 17 is a perspective view of a passenger-carrying chair which is lowered along a cable and has a friction-inducing device along each side thereof, one device having arms that are upwardly inclined and the other side having arms that are downwardly inclined with the cable passing first through the upwardly inclined arms, then along the bottom of the chair, and finally between the downwardly inclined arms.
Figure 18:
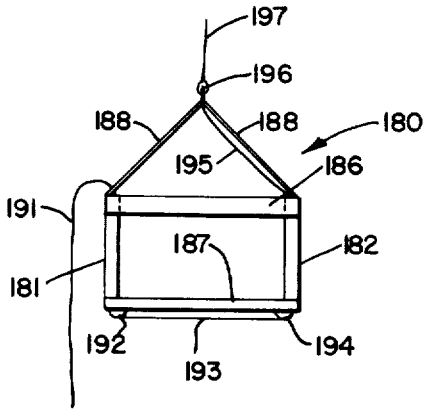
FIG. 18 is a rear view of the chair of FIG. 17.
Figure 19:
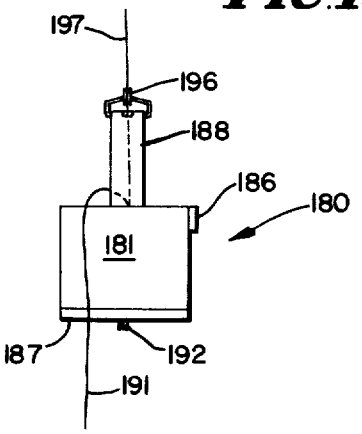
FIG. 19 is a left-side view of the device of FIG. 17.

The load-accompanying descent device 180, shown in FIGS. 17, 18, and 19, utilizes and comprises two pairs of alternatively opposed arms which are incorporated into a passenger-carrying chair. This chair comprises support struts 188 which are attached to the rigid frames of the first device 181 and the second device 182, both being rigidly interconnected by a top back member 186 and a chair bottom 187.

The loose incoming cable 191, which extends to the ground as a single length or as part of an endless cable, enters the first device 181 wherein it passes over the alternatively opposed and upwardly inclined arms 183 therein and emerges to turn at right angles over the first bottom pulley 192. The cable, as bottom run 193, then proceeds to the second bottom pulley 194 and passes upwardly between the alternatively opposed and downwardly inclined arms 184 of the second device 182, emerging as an inclined run 195 to pass over a pulley 196 and leave the device as taut run 197 which is attached to a load-supporting hook thereabove.

The static applications for the invention that are shown in FIGS. 1, 6, 11, 12, and 16 and the travelling applications that are shown in FIGS. 9 and 17 are preferably constructed for a limited load range, such as 75–250 pounds, 150–500 pounds, 400–1,000 pounds, and the like, in order to obtain a selected amount of constraint upon the cable passing between the alternatively opposed banks of arms. Furthermore, the thickness and stiffness of the cable and the frictional composition of the tips of the arms can be similarly selected to provide a desired amount of such restraint, preferably over a selected limited range that permits the angle of inclination of the arms to be varied by the weight of the load. In addition, the length of the arms, the length of the grooves which are available for contact with the cable, the number of friction-inducing arms in each bank of a pair of banks, the number of paired banks, and the angle of initial inclination of the arms are preferably selected for operation with loads of a limited range in order to obtain a desired rate of descent, responsiveness to weight of the load, and minimizing of shocks during descent.

Although all anchor frames have hereinbefore been described and shown as rigid in construction, it is merely necessary that such frames have sufficient transversely directed strength to withstand the sum of the transversely directed pressures **76*h*** which are generated along each zigzag path by the cable resultants of all arms. Consequently, it is within the scope of this invention to provide a transversely extensible anchor frame having a transversely acting resiliency means, in combination with rigid arms or with arms having their own resiliency means, for selectively varying the zigzag path and the constraint forces generated therealong.

Because it will be readily apparent to those skilled in the art that innumerable variations, modifications, applications, and extensions of these embodiments and principles can be made without departing from the spirit and scope of the invention, wherein it is herein defined as such scope and is desired to be protected should be measured and the invention should be limited, only by the following claims.

What is claimed is:

1. A controlled-speed descent device for safely lowering a load on a cable, comprising:

A. a rigid anchor frame, comprising a first side member and a second side member and rigidly attached interconnecting members therebetween and having a vertically disposed center into which an incoming portion of said cable feeds;

B. a first bank of generally parallel friction-inducing arms which:

1. are inclined toward said incoming portion,
2. are pivotably attached to and extend from first side member toward said center, and
3. have cable-retarding tips which are generally disposed in parallel with said center;

C. a second bank of generally parallel friction-inducing arms which:

1. are inclined toward said incoming portion,
2. are pivotably attached to and extend from said second side member toward said center, and
3. have cable-retarding tips which alternatively oppose said tips of first bank; and D. a groove means in said tips for defining a zigzag path for said cable passing therebetween approximately along said center and in parallel to said side members; two of said devices being attached to and accompanying a passenger-carrying chair as said load, said chair comprising;

a bottom and a pair of side which are rigidly attached thereto, each said side comprising one said anchor frame of one said controlled-speed descent device, one side of said pair of sides having downwardly extending arms and the other side of said pair of sides having upwardly extending arms.

2. The controlled-speed descent device of claim 1 wherein said chair is rigidly attached to a pair of upwardly extending struts having a pulley therebetween over which said cable passes before passing zigzaggingly downwardly through said downwardly extending arms and further wherein said chair comprises a pair of pulleys along the bottom thereof over which said cable passes as a bottom run thereof before passing zigzaggingly upwardly through said upwardly extending arms.

3. A controlled-speed descent device for safely lowering a load on a cable, comprising:

A. a rigid anchor frame, comprising a first side member and a second side member and rigidly attached interconnecting members therebetween and having a vertically disposed center into which an incoming portion of said cable feeds;

B. a first bank of generally parallel friction-inducing arms which:

1. are inclined toward said incoming portion,
2. are pivotably attached to and extend from first side member toward said center,
3. have cable-retarding tips which comprise a friction-inducing composition and are generally disposed in parallel with said center, and
4. comprise a resiliency means for absorbing shocks and minimizing binding forces upon said cable;

C. a second bank of generally parallel friction-inducing arms which:

1. are inclined toward said incoming portion,
2. are pivotably attached to and extend from said second side member toward said center,
3. have cable-retarding tips which comprise a friction-inducing composition and alternatively oppose said tips of first bank, and
4. comprise a resiliency means for absorbing shocks and minimizing binding forces upon said cable; and D. a groove means in said tips for defining a zigzag path for said cable passing therebetween approximately along said center and in parallel to said side members.

4. The controlled-speed descent device of claim 3 wherein each said arm comprises a sleeve and a piston fitting slidably therewithin.

5. The controlled-speed descent device of claim 4 wherein said resiliency means is disposed within each said sleeve and urges said piston outwardly towards said center.

6. The controlled-speed descent device of claim 5 wherein said resiliency means is a coiled spring.

7. The controlled-speed descent device of claim 5 wherein said resiliency means is a leaf spring.

8. The control speed descent device of claim 5 wherein each said arm is filled with a hydraulic fluid and each said piston has a closed bottom with fluid-transmitting holes therein.

9. The controlled-speed descent device of claim 8 wherein said holes have a size adapted for varying the speed of travel of said device along said cable.

10. The controlled-speed descent device of claim 3 wherein said tips comprises a roller which is attached to a brake assembly.

11. The controlled-speed descent device of claim 10 wherein said brake assembly comprises a ratchet wheel which is attached to said roller and connected to a spring pawl which is attached to said arm.

12. The controlled-speed descent device of claim 3 wherein said arm comprises a pair of laterally spaced-apart members which permit said first arms and said second arms to be interlaced through each other so that said zigzag path is widely extended laterally.

13. A descent device for lowering a load along a vertically disposed load-supporting cable at a selected regulated rate of descent, comprising:

A. an anchor frame, which is capable of selectively withstanding transversely directed pressures generated by cable-retarding forces, and B. a weight-responsive friction-inducing means for restricting said cable to a selected zigzag path and for selectively tensioning said cable and thereby increasing cable-retarding friction in proportion to the weight of said load, said friction-inducing means comprising a pair of banks of parallel and alternatively opposed friction-inducing arms which:

1. are pivotable attached to said anchor frame and have cableretarding tips over which said cable passes in arcuate contact along said zigzag path,
2. are pivotable attached to tie rod which is disposed generally in parallel to said load-supporting cable, and
3. comprise a resiliency means for absorbing shocks and minimizing binding forces upon said cable.

14. A controlled-speed descent device for safely lowering a load on a cable, comprising:

A. a rigid anchor frame, comprising a first side member and a second side member and rigidly attached interconnecting members therebetween and having a vertically disposed center into which an incoming portion of said cable feeds, said frame being attached to and suspended from a bracket which is attached to an elevated structure and said cable being stored on a reel attached to said bracket, passing through said anchor frame along a zigzag path, and emerging as an outgoing run supporting said load;

B. a first bank of generally parallel friction-inducing arms which:

1. are inclined toward said incoming portion,
2. are pivotably attached to and extend from first side member toward said center,
3. have cable-retarding tips which are generally disposed in parallel with said center, and
4. are pivotably attached to a tie rod which is disposed substantially in parallel to said side members;

C. a second bank of generally parallel friction-inducing arms which:

1. are inclined toward said incoming portion,
2. are pivotably attached to and extend from said second side member toward said center,
3. have cable-retarding tips which alternatively oppose said tips of first bank, and
4. are pivotably attached to a second tie rod; and D. a groove means in said tips for defining said zigzag path for said cable passing therebetween approximately along said center and in parallel to said side members, said outgoing run of said cable passing through a load block and returning to a fastening position on one of said tie rods.

15. A controlled-speed descent device for safely lowering a load on a cable, comprising:

A. a rigid anchor frame, comprising a first side member and a second side member and rigidly attached interconnecting members therebetween and having a vertically disposed center into which an incoming portion of said cable feeds, said frame being attached to and suspended from a bracket which is attached to an elevated structure and said cable being stored on a reel attached to said bracket passing through said anchor frame along a zigzag path, and emerging as as outgoing run supporting said load;

B. a first bank of generally parallel friction-inducing arms which:

1. are inclined toward said incoming portion,
2. are pivotably attached to and extend from first side member toward said center,
3. have cable-retarding tips which are generally disposed in parallel with said center, and
4. are pivotably attached to a tie rod which is disposed substantially in parallel to said side members;

C. a second bank of generally parallel friction-inducing arms which:

1. are inclined toward said incoming portion,
2. are pivotably attached to and extend from said second side member toward said center,
3. have cable-retarding tips which alternatively oppose said tips of first bank, and
4. are pivotably attached to a second tie rod; and D. a groove means in said tips for defining said zigzag path for said cable passing therebetween approximately along said center and in parallel to said side members, said first tie rod and said second tie rod being rigidly interconnected to form a tie-rod frame and said outgoing run of said cable passing through a load block and returning to said descent device, being fastened to said tie-rod frame.

16. A passenger-carrying chair for safely lowering a passenger on a cable, comprising:

A. a passenger-supporting bottom upon which said passenger sits; and

B. a pair of passenger-retaining sides which are rigidly attached along their lower edges to said bottom along its opposite edges, each said side comprising a controlled-speed descent device which comprises:

1. a rigid anchor frame, comprising a first side member and a second side member and rigidly attached interconnecting members therebetween and having a vertically disposed center into which an incoming portion of said cable feeds;

2. a first bank of generally parallel friction-inducing arms which:
   a. are inclined toward said incoming portion,
   b. are pivotably attached to and extend from first side member toward said center, and
   c. have cable-retarding tips which are generally disposed in parallel with said center;
3. a second bank of generally parallel friction-inducing arms which:
   a. are inclined toward said incoming portion,
   b. are pivotably attached to and extend from said second side member toward said center, and
   c. have cable-retarding tips which alternatively oppose said tips of first bank; and
4. a groove means in said tips for defining a zigzag path for said cable passing therebetween approximately along said center and in parallel to said side members;

said first and second banks having downwardly extending arms in one said passenger-retaining side of said chair and having upwardly extending arms in the other said passenger-retaining side thereof.

17. In a descent device for safely lowering passengers and materials from an elevated position to a lower position, a weight-responsive means for controlling speed of descent thereof along a load-supporting cable, comprising:

A. an anchor frame which is capable of withstanding transversely directed pressures generated by cable-retarding forces; and B. a pair of banks of parallel and alternatively opposed friction-inducing arms which:
   1. are inclined toward the incoming portion of said cable,
   2. are pivotably attached to said anchor frame,
   3. have tips which are in movable contact with said cable along an arc of contact of variable length and which guide said cable along a zigzag path, and
   4. are pivotably attached to a tie rod disposed between said tips and said anchor frame and generally in parallel to said cable, whereby said arms in each said bank operate in unison whereby said arms are pivotably responsive to the weight of said load so that on each said arm a turning moment is generated in the direction of movement of said cable and whereby an axially directed force is generated which alters the frictional pressure between said cable and said tips in proportion to said load and which is transmitted to said anchor frame as a portion of said transversely directed pressure, said cable being passed downwardly from said device, through a load block, and upwardly to a fastening position on one of said tie rods.

18. The weight-responsive means of claim 17 wherein each said arm comprises a resiliency means for absorbing shocks and minimizing binding forces upon said cable.

19. The weight-responsive means of claim 18 wherein said resiliency means comprises a spring means for selectively shortening the length of each said arm in proportion to said tensional pressures whereby jerkiness in movement along said cable is reduced.

20. The weight-responsive means of claim 19 wherein each said arm comprises a sleeve containing said spring means and a slidably interfitted piston.

* * * * *